US007810672B1

(12) United States Patent
Mason et al.

(10) Patent No.: US 7,810,672 B1
(45) Date of Patent: Oct. 12, 2010

(54) DISPLAY DEVICE

(75) Inventors: Timothy L. Mason, Melville, NY (US); Jeffrey Sherretts, North Babylon, NY (US); Chet Finkbeiner, Coram, NY (US); Harry R. Burger, Huntington Station, NY (US)

(73) Assignee: New Dimensions Research Corporation, Melville, NY (US)

( * ) Notice: Subject to any disclaimer, the term of this patent is extended or adjusted under 35 U.S.C. 154(b) by 461 days.

(21) Appl. No.: 12/006,672

(22) Filed: Jan. 4, 2008

Related U.S. Application Data

(60) Provisional application No. 60/878,709, filed on Jan. 4, 2007.

(51) Int. Cl.
*B65G 59/06* (2006.01)

(52) U.S. Cl. ..... 221/256; 221/263; 221/265; 221/266

(58) Field of Classification Search ..... 221/256, 221/263, 265, 266
See application file for complete search history.

(56) References Cited

U.S. PATENT DOCUMENTS 3,433,545 A * 3/1969 Rainey ..... 221/92
5,295,592 A * 3/1994 Thorne ..... 221/194
5,433,341 A * 7/1995 Polvere et al. ..... 221/283
6,598,760 B1 * 7/2003 Wilson ..... 221/131
D486,324 S 2/2004 Mason
D489,556 S 5/2004 Mason
D496,193 S 9/2004 Mason
6,877,618 B2 4/2005 Mason
D511,426 S 11/2005 Mason
7,131,543 B2 11/2006 Mason
7,303,095 B2 * 12/2007 Nagelski et al. ..... 221/256

* cited by examiner

*Primary Examiner*—Gene Crawford
*Assistant Examiner*—Timothy R Waggoner
(74) *Attorney, Agent, or Firm*—Collard & Roe, P.C.

(57) ABSTRACT

A display device includes a chute supporting products in a stacked arrangement and a cartridge assembly for dispensing a lowermost product. The cartridge assembly includes a movable pocket biased in a closed position. A lever switch has a portion disposed within the pocket. An escapement member has an escapement arm and an escapement shelf disposed over the pocket. A cam body coupled to the lever switch has a cam surface. A timer device is disposed between the pocket and escapement member. As a product is removed from the pocket, the lever switch is raised. As the pocket is closed, the cam surface engages the escapement member, moving the escapement member into a retracted position, and allowing a product to drop from the chute into the pocket. This depresses the lever switch, moving the cam body and returning the escapement member to its forward position.

21 Claims, 13 Drawing Sheets

DISPLAY DEVICE

CROSS REFERENCE TO RELATED APPLICATIONS

This application claims the benefit of U.S. Provisional Application Ser. No. 60/878,709 filed on Jan. 4, 2007.

BACKGROUND OF THE INVENTION

1. Field of the Invention

The present invention relates to display devices and more particularly to a display device suitable for display of packages of small consumer items such as razor blades and which is designed to reduce or inhibit shoplifting of such items from the display.

2. Prior Art

The display of merchandise such as razor blades and other such items having small package dimensions at retail establishments presents problems because of the risk that shoplifters will remove large quantities of such items from the display, conceal them on their person, and leave the store without paying for them. To guard against such risk, retail stores sometimes keep such items in locked cabinets or behind the counter where store personnel are located; however, doing so is not entirely satisfactory because consumers may be disinclined to find a store employee to get access to the merchandise and therefore decide to buy the merchandise at a different store, which may or may not occur.

The present invention is directed to solving this problem by providing a display device that permits the display of such merchandise such as razor blades for the consumer in a normal retail area, yet inhibits or prevents shoplifters from easily removing large quantities of such merchandise quickly from the display in order to steal it. The display device also provides a mechanism that allows for a large graphic area to be placed in front of the inventory.

In particular, sales data indicate that honest shoppers very rarely purchase multiple packages of certain products, such as razor blades, in a single visit. Accordingly, a person seeking multiple packages of certain products, such as razor blades, may constitute suspicious behavior. By increasing the time required for a person to obtain multiple products from a display device according to various embodiments of the invention, the likelihood that a store clerk, customer or other person will notice this suspicious behavior is increased, thereby discouraging theft.

SUMMARY OF THE INVENTION

The present invention relates to display devices and more particularly to a display device suitable for display of packages of small consumer items such as razor blades and which is designed to reduce or inhibit shoplifting of such items from the display.

A display device according to an embodiment of the invention includes a chute for supporting a plurality of products in a stacked arrangement and a cartridge assembly disposed at a lower end of the chute for dispensing a lowermost product of the plurality of products.

The cartridge assembly includes a pocket for receiving the product to be dispensed. The pocket is movable between an open position wherein the product may be removed from the pocket and a closed position. A first biasing member is coupled to the pocket for biasing the pocket into its closed position.

The cartridge assembly further includes a lever switch which has a portion disposed within the pocket. The lever switch is movable between a depressed position when the product is disposed within the pocket and a raised position when the product is removed from the pocket. A second biasing member is coupled to the lever switch for biasing the lever switch into its raised position.

The cartridge assembly further includes an escapement member including an escapement arm having a recess and an escapement shelf disposed over the pocket when the escapement member is in a forward position. The escapement member is movable between this forward position, wherein the escapement shelf prevents a product of the plurality of products in said chute from dropping into the pocket, and a retracted position, wherein the product can drop from the chute into the pocket.

A cam body having a cam surface is coupled to the lever switch. The cam body is movable between a first position wherein the cam surface is received in the escapement arm recess and a second position wherein the cam surface is not received in the recess.

A timer device is disposed between the pocket and the escapement member for retarding a rate of movement of the escapement member between its forward and retracted positions.

As the product is removed from the pocket when the pocket is in its open position, the lever switch moves to its raised position and the cam body moves to its second position. As the pocket is subsequently moved from its open position to its closed position, the cam surface engages the escapement member, moving the escapement member into its retracted position, which allows another of the plurality of products to drop from the chute into the pocket. As this product drops from the chute into the pocket, the lever switch is moved to its depressed position, moving the cam body into its first position and returning the escapement member to its forward position.

In another embodiment, the cartridge assembly is detachable from the chute.

In another embodiment, the display device further includes a brake arm coupled to the escapement member. The brake arm is movable between an engaged position, wherein the brake arm presses against a product in the chute and prevents the product from dropping in the chute, and a released position, wherein the product can drop in the chute onto the escapement shelf. As the escapement member is moved from its retracted position to its forward position, the brake arm moves from its engaged position to its released position. The brake arm may include one or more brake pads, for contacting the product when the brake arm is in its engaged position.

In another embodiment, the first biasing member includes a spring, for example a coil spring. In another embodiment, the second biasing member includes a spring, for example a flat spring.

In another embodiment, the timer device includes a flexible bladder, attached to a stationary plane, which may include a large aperture through which air can enter with a small aperture through which air can escape and a passive valve to seal off the large aperture when the pocket closes. The large aperture may be positioned to be covered by a sealing membrane secured to the rear portion of the pocket as the pocket moves into its closed position. A spring may be disposed within the flexible bladder for increasing a rate of inflation of the flexible bladder as the pocket is moved from its closed to its open position.

The flexible bladder may also be in the form of a bellows which is coupled to the pocket and to a stationary plane. The bellows may include two apertures, for example a large aperture through which air can enter and a smaller aperture through which air may escape. A valve, such as a passive valve, may be provided, wherein the valve closes the large aperture when the pocket closes.

In another embodiment, the display device includes a first divider and a second divider. The cartridge assembly is arranged between the first and second divider. A first adjustable guide is coupled to the first divider and a second adjustable guide is coupled to the second divider. The adjustable guides define a portion of the chute and are movable for adjusting the chute to accommodate products of various sizes.

In another embodiment the first divider has a first projection and the second divider has a second projection. The first adjustable guide includes a first plurality of spaced apart openings for receiving the first projection and the second adjustable guide includes a second plurality of spaced apart openings for receiving the second projection.

In another embodiment, the display device includes a locking mechanism which is movable between an unlocked state, wherein the pocket can be moved from its closed position to its open position, and a locked state, wherein the pocket cannot be moved from its closed position to its open position. The locking mechanism may include a hook rotatably coupled to the cartridge assembly and a pin, wherein the hook engages the pin when the locking mechanism is in its locked state In another embodiment, the display device includes a locking mechanism which is movable between an unlocked state, wherein the pocket can be moved from its closed position to its open position, and a locked state, wherein the pocket cannot be moved from its closed position to its open position. The locking mechanism may include a horizontal enclosure with retractable pins at each end. The inner portions of the pins are connected to the rotating part of a centrally positioned keyed cam lock. Turning the key retracts the pins allowing the mechanism to move freely between the closed and open positions. With the key rotated to its removable station the pins are extended and engaged into corresponding holes to secure the mechanism into either the unlocked state or the locked state.

In another embodiment, the display device includes an indicator for indicating an amount of the plurality of products in the chute. The indicator may include an upwardly biased lever disposed in the chute and a flag coupled to the upwardly biased lever.

In another embodiment, a plurality of cartridge assemblies are arranged in a line and separated by respective dividers. Each of the respective dividers has an opening therethrough and each of the cartridge assemblies has a respective projection. A cable extends through the opening in each of the dividers. As a pocket of one of the cartridge assemblies is moved to its open position, the projection associated that cartridge assembly imparts a tension on the cable and prevents a pocket from each of the other cartridge assemblies from being moved to an open position.

An advantage of a display device according to an embodiment of the invention is that the theft of products displayed therein is prevented or reduced by providing a pocket for dispensing a limited number (preferably one) of the products at a time, wherein a timer device is employed for delaying the refilling of the pocket with another product from a chute supporting a number of such products in the display.

This delay in refilling of the pocket substantially increases the time required to retrieve more than one product from the display, thus impeding prospective thieves from taking multiple pieces of the same product.

Another advantage of a display device according to an embodiment of the invention is that an adjustable chute is provided, wherein the chute for supporting the products to be dispensed is adjustable to accommodate various sizes of product packaging. Moreover, in an embodiment of a display device according to the invention, a chute may be adjusted without the need to adjust a cartridge assembly associated with the chute.

A further advantage of a display device according to an embodiment of the invention is that a locking device may be provided for locking the pocket such that the pocket cannot be moved from its closed position to its open position, thereby providing a greater degree of security.

A further advantage of a display device according to an embodiment of the invention is that an indicator may be provided for indicating the number of products in the chute, thereby facilitating the stocking and reloading of the display device.

A further advantage of a display device according to an embodiment of the invention is that a display device may be provided including a number of cartridge assemblies arranged in a line or row, wherein a tensioning mechanism allows only one dispensing pocket in the row to opened at once and prevents the opening of multiple pockets in a row at the same time.

BRIEF DESCRIPTION OF THE DRAWINGS

Other benefits and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE DRAWINGS

Figure 1:
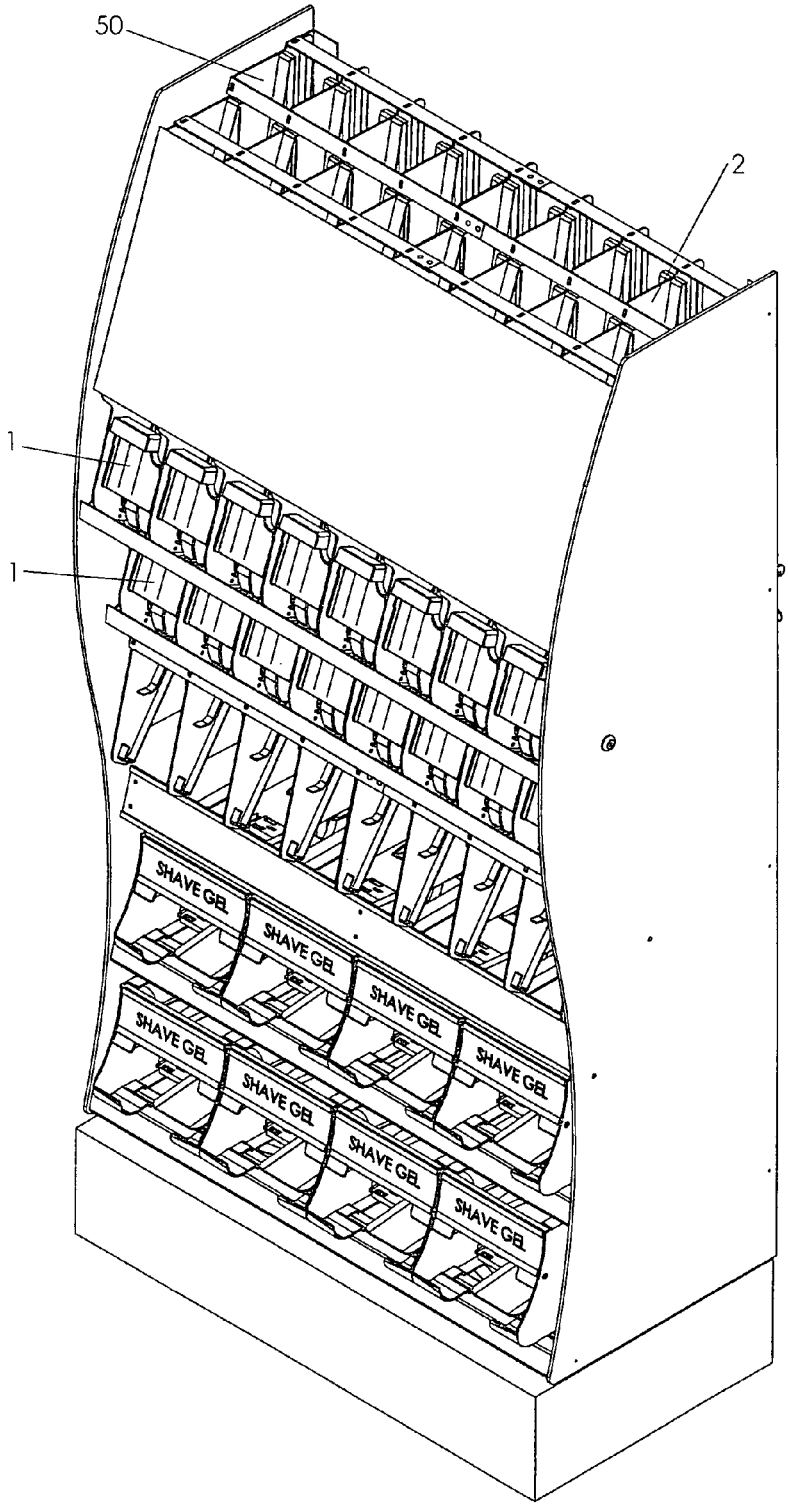
FIG. 1 shows a perspective view of a display device assembly according to an embodiment of the invention.

Referring now in detail to the drawings and, in particular, FIG. 1 shows a display device assembly according to an embodiment of the invention. The display device is designed to display and dispense various products including modular merchandise units such as packet boxes filled with merchandise such as razor blades.

The components of a display device according to an embodiment of the invention may be formed from injection molded plastic, or from any other suitable materials. For example, most of the parts of the display device may comprise polystyrene. Other parts may comprise acetal, polycarbonate or other resins as dictated by particular needs. The spring components may be formed from various grades of steel.

Figure 2:
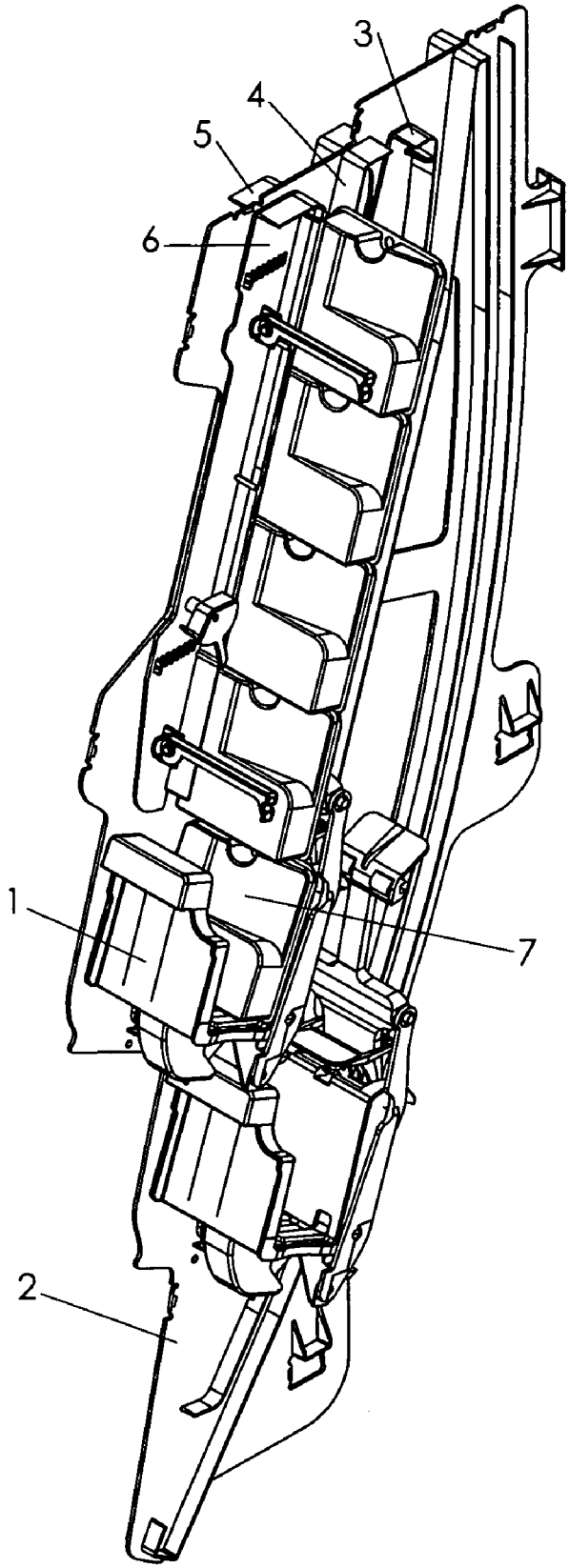
FIG. 2 shows a cartridge assembly and chute with a plurality of products disposed therein according to an embodiment of the invention.

The display device may include one or more chutes 50 for supporting a plurality of products 7 in a stacked arrangement, as shown for example in FIG. 2. Chutes 50 may be defined by a pair of dividers 2 and a pair of guides 6. Dividers 2 may define a side portion of chute 50 and guides 6 may define a front portion of chute 50. An additional pair of guides 4 may define a rear portion of chute 50.

Figure 7A:
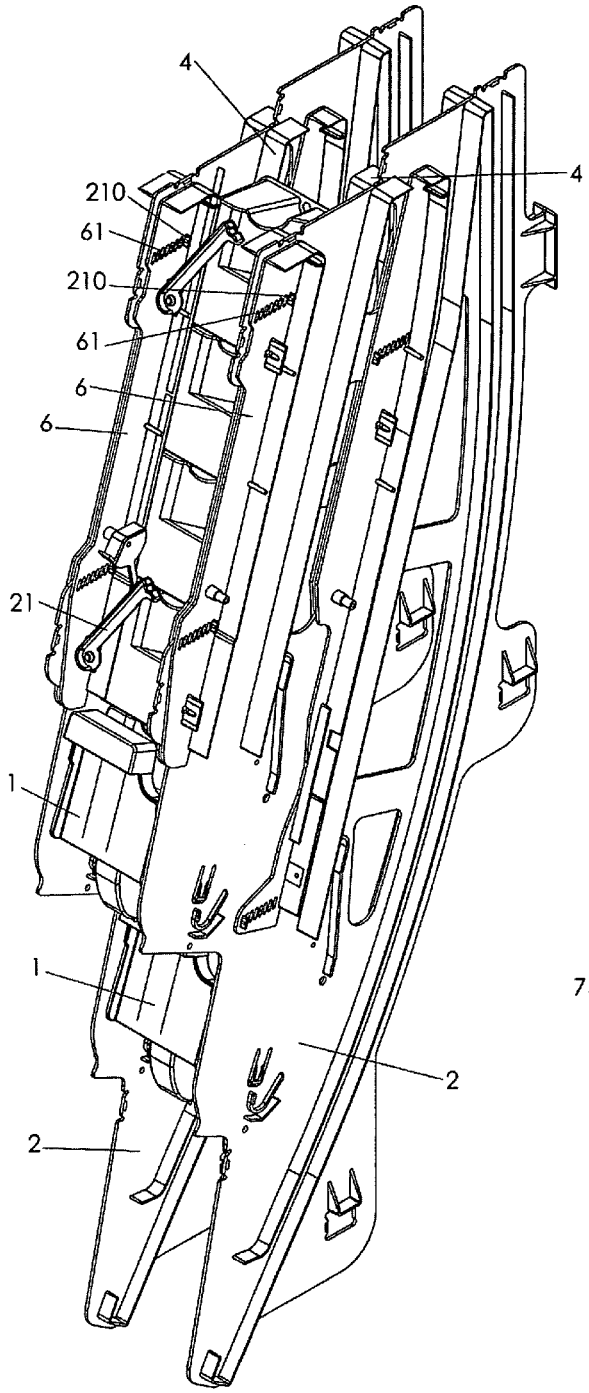
FIG. 7A shows a perspective view of a display device according to an embodiment of the invention wherein adjustable front guides are positioned to accommodate a relatively large product.
Figure 7B:
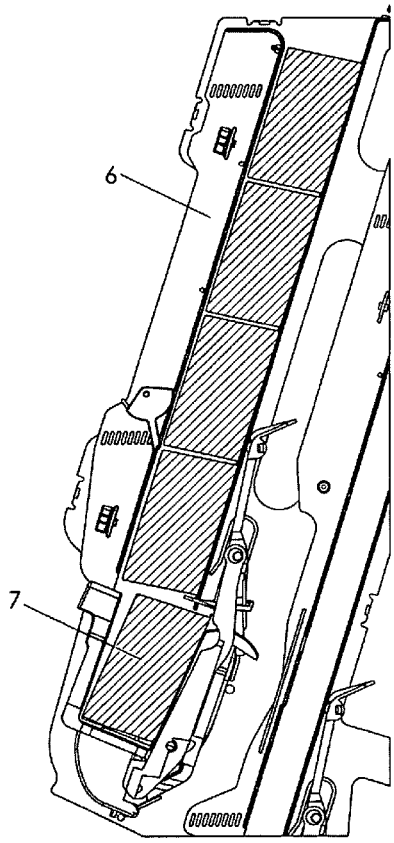
FIG. 7B shows a side view of a display device according to an embodiment of the invention wherein adjustable front guides are positioned to accommodate a relatively large product.

Guide 6 may comprise an adjustable guide and guide 4 may comprise a fixed guide, wherein adjustable guide 6 is movable for adjusting the dimensions of chute 50 to accommodate products of various sizes, as shown, for example in FIGS. 7A and 7B and described in greater detail hereinafter. Guide 4 may comprise a rib projecting from divider 2 and may be formed integrally with divider 2.

As shown in FIGS. 1 and 2, divider 2 may comprise a center divider which is disposed between two adjacent cartridge assemblies 1. Moreover, multiple cartridge assemblies 1 in the display device may be arranged between a pair of dividers 2. For example, cartridge assemblies 1 may be arranged between a pair of dividers 2 one behind another as shown, with a first cartridge assembly 1 disposed higher than and in front of a second cartridge assembly, the second cartridge assembly being disposed lower than and behind the first cartridge assembly.

In this arrangement, as shown in FIG. 2, center divider 2 may include a left front guide 6 and a left rear guide 3 for forming the respective chutes associated with the higher front cartridge assembly and the lower rear cartridge assembly, respectively. Right front guides and right rear guides may be disposed on the opposite side of center divider 2 for forming the chutes associated with front and rear cartridge assemblies located on the opposite side of center divider 2.

The cartridge assemblies may be arranged in parallel rows in the display device, with a divider 2 positioned between adjacent cartridge assemblies and end sections positioned on opposite ends adjacent the last cartridge assembly in the row, as shown for example in FIG. 1. Cartridge assemblies 1 may be detachable from dividers 2 and chute 50, thereby achieving a modular display device assembly.

Each cartridge assembly 1 is disposed at a lower end of a respective chute 50 for dispensing a lowermost product 7 from the supply of products 7 supported in the chute 50.

Figure 3A:
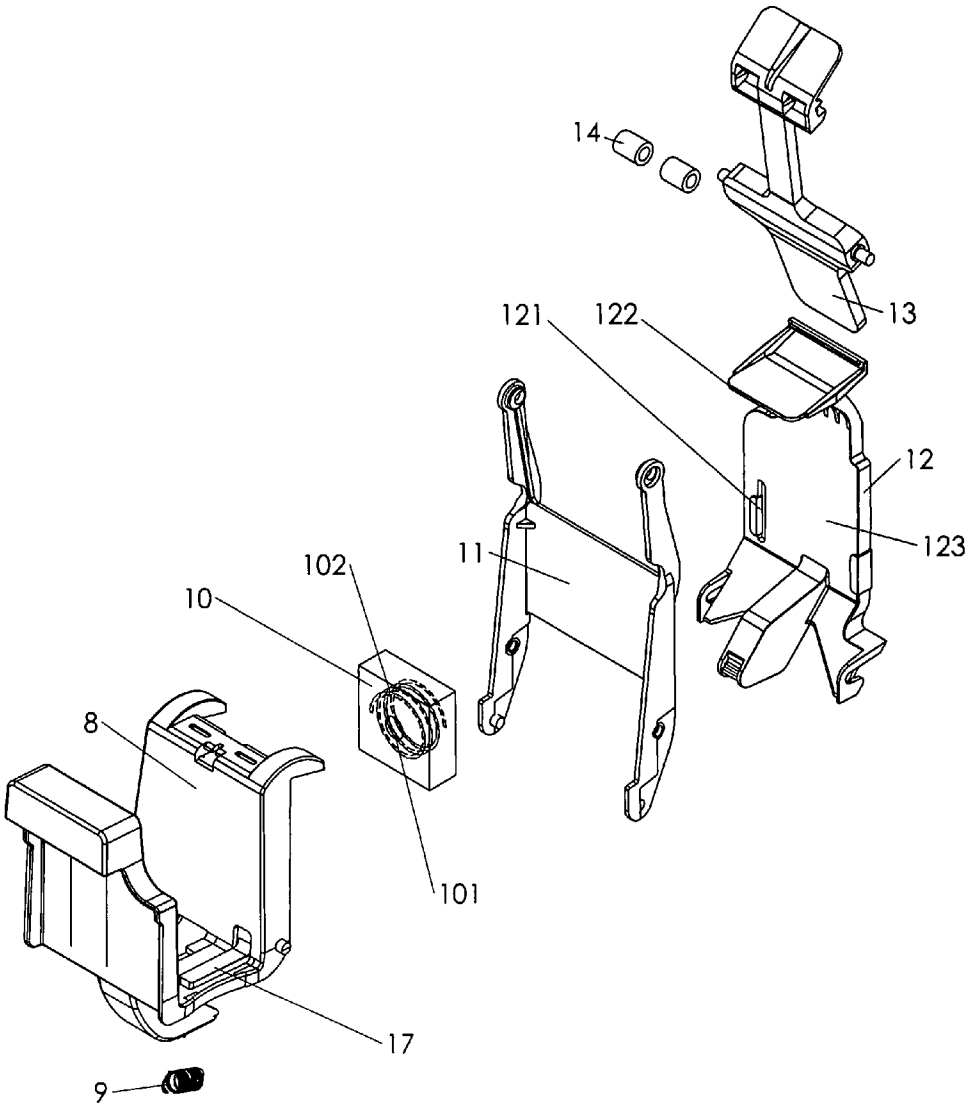
FIG. 3A shows an exploded view of a cartridge assembly according to an embodiment of the invention.
Figure 3B:
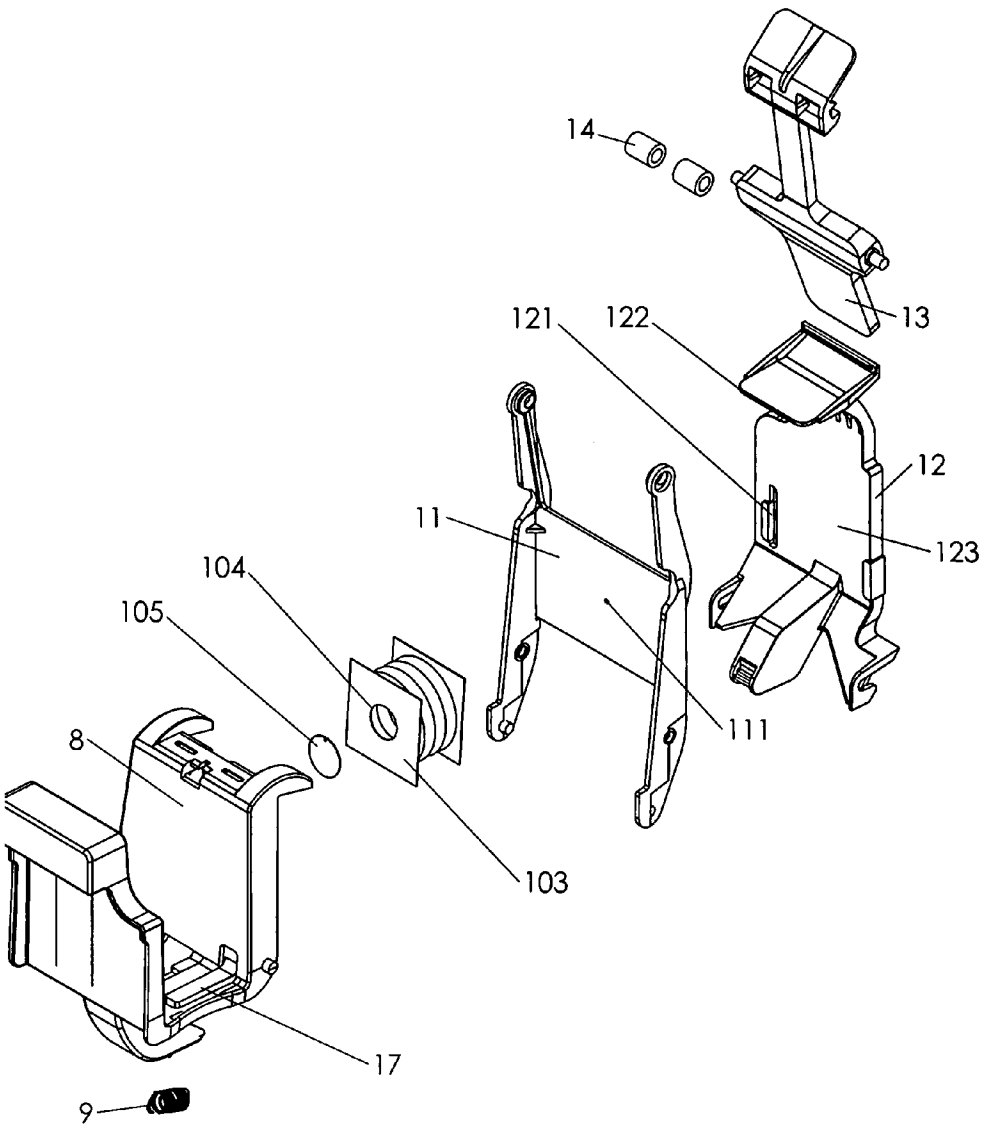
FIG. 3B shows an exploded view of a cartridge assembly according to another embodiment of the invention.
Figure 4:
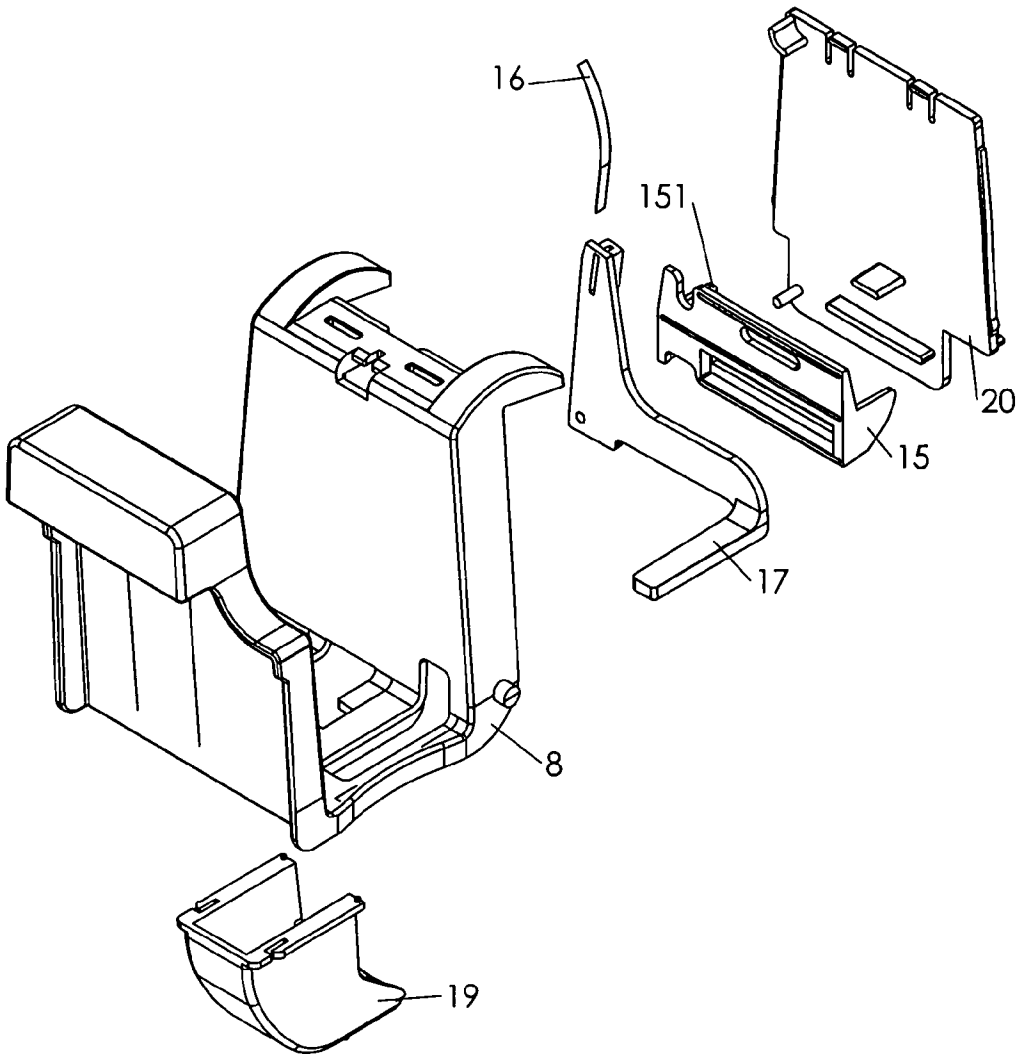
FIG. 4 shows a further exploded view of a cartridge assembly according to an embodiment of the invention.
Figure 6B:
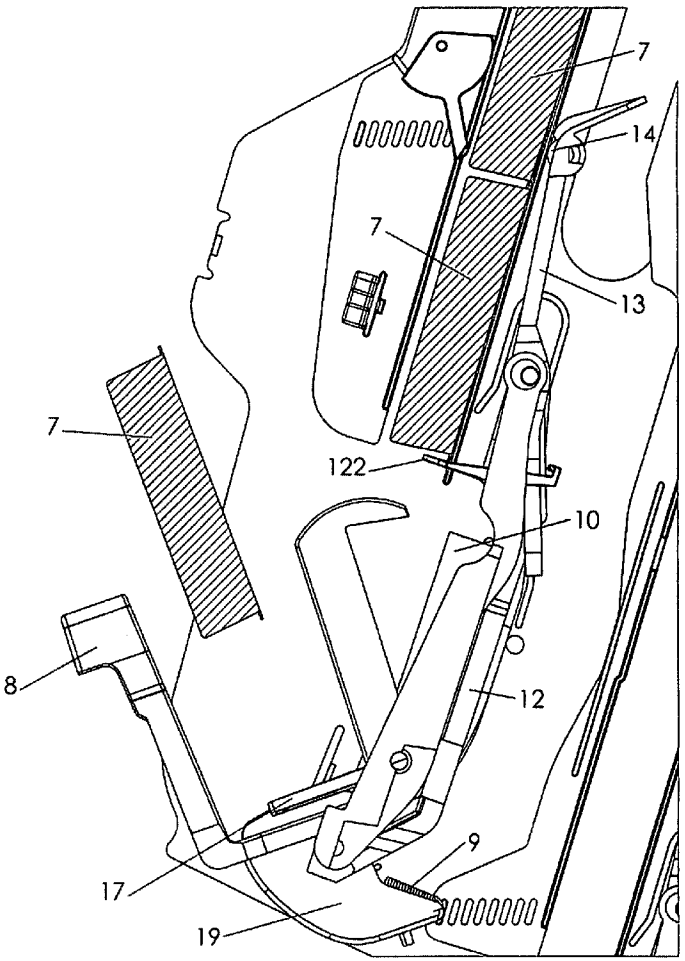
FIG. 6B shows a side view of a cartridge assembly according to an embodiment of the invention, wherein the pocket is in an open position and the product is being removed.

FIGS. 3A, 3B and 4 show exploded views of a cartridge assembly according to an embodiment of the invention. Cartridge assembly 1 includes a pocket or pull cradle 8 for receiving the product to be dispensed. Pocket 8 is movable between an open position wherein the product may be removed from pocket 8 (see FIG. 6B) and a closed position (see FIG. 6A). A first biasing member 9 is coupled to a pocket 8 for biasing pocket 8 into its closed position. First biasing member 9 may be a spring, such as a coil spring. A spring housing 19 may be provided which covers all or a portion of first biasing member 9. FIG. 6B shows an embodiment wherein first biasing member 9 comprises a coil spring disposed with spring housing 19 positioned on an underside of pocket or pull cradle 8.

A lever switch 17 or floor lever has a portion disposed within pocket 8. Lever switch 17 is movable between a depressed position when product 7 is disposed within pocket 8 and a raised position when product 7 is removed from pocket 8. A second biasing member 16 for biasing the lever switch is coupled to the lever switch. Second biasing member 16 may be a spring, such as a flat spring. In operation, when a product 7 is disposed within pocket 8, the product 7 contacts lever switch 17 and the weight of product 7 overcomes the force of second biasing member 16, moving lever switch 17 into its depressed position. When product 7 is removed from pocket 8, second biasing member 16 moves lever switch 17 into its raised position.

Figure 5A:
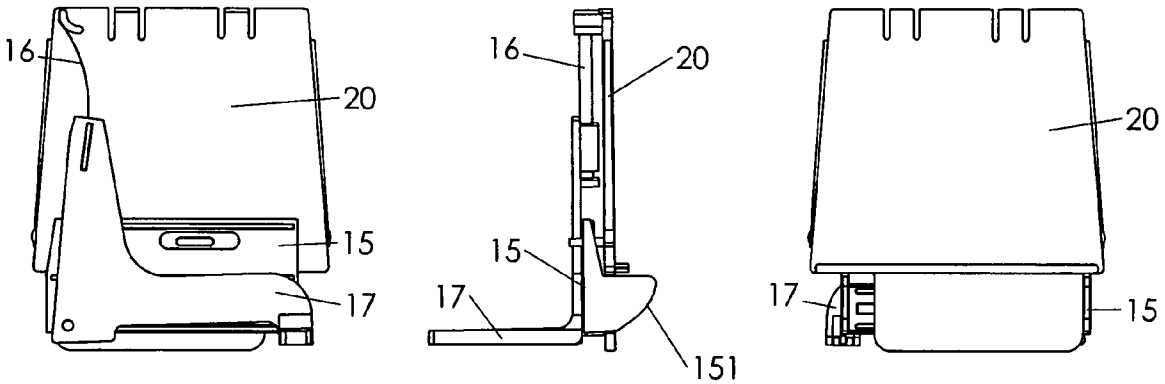
FIG. 5A shows a pocket, lever switch and cam body according to an embodiment of the invention, showing the respective positions of the lever switch and cam body when the pocket is filled.
Figure 5B:
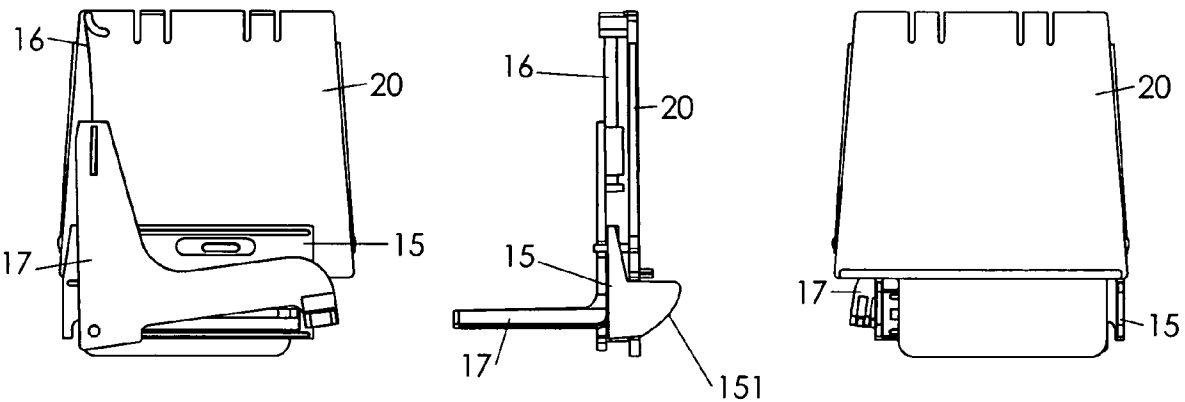
FIG. 5B shows a pocket, lever switch and cam body according to an embodiment of the invention, showing the respective positions of the lever switch and cam body when the pocket is empty.

FIG. 5A shows lever switch 17 in its depressed position, as when a product 7 is disposed within pocket 8. FIG. 5B shows lever switch 17 in its raised position, as when pocket 8 is empty and no product 7 is disposed therein.

Figure 6A:
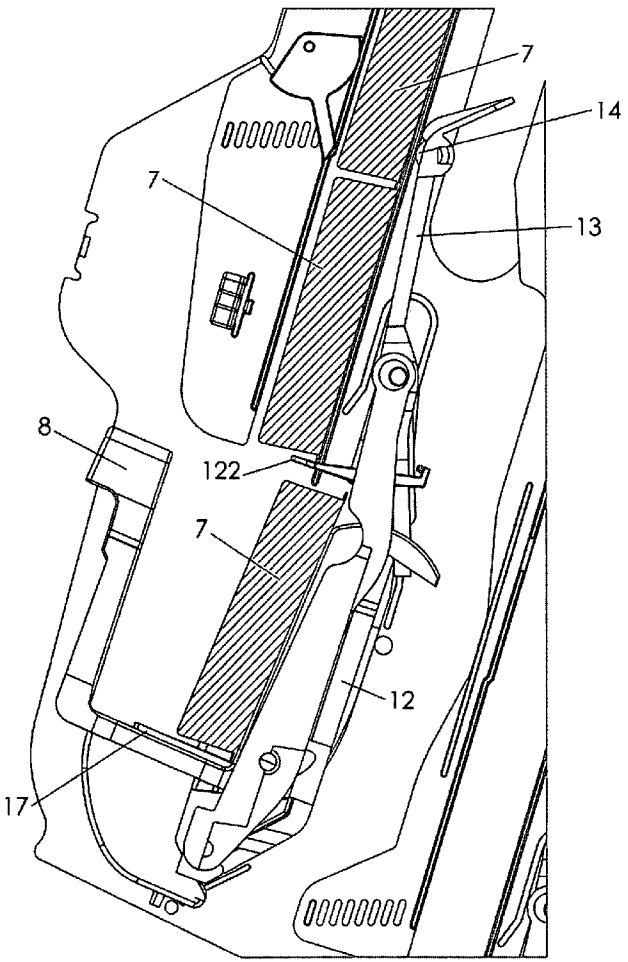
FIG. 6A shows a side view of a cartridge assembly according to an embodiment of the invention, wherein the pocket is in a closed position, with a product to be dispensed disposed in the pocket.

FIGS. 3A, 3B and 6A show cartridge assembly 1 further includes an escapement member 12. Escapement member 12 includes an escapement arm 123 having a recess 121, which may be an aperture, such as a slotted opening. Escapement member 12 is movable between a forward position wherein escapement shelf 122 is disposed over pocket 8, thereby preventing a product or products 7 in chute 50 from dropping into pocket 8, and a retracted position wherein a product 7 can drop from chute 50 into pocket 8. The portion of chute 50 wherein product 7 rests on escapement shelf 122 of escapement member 12 may be referred to as the holding area.

Figure 6C:
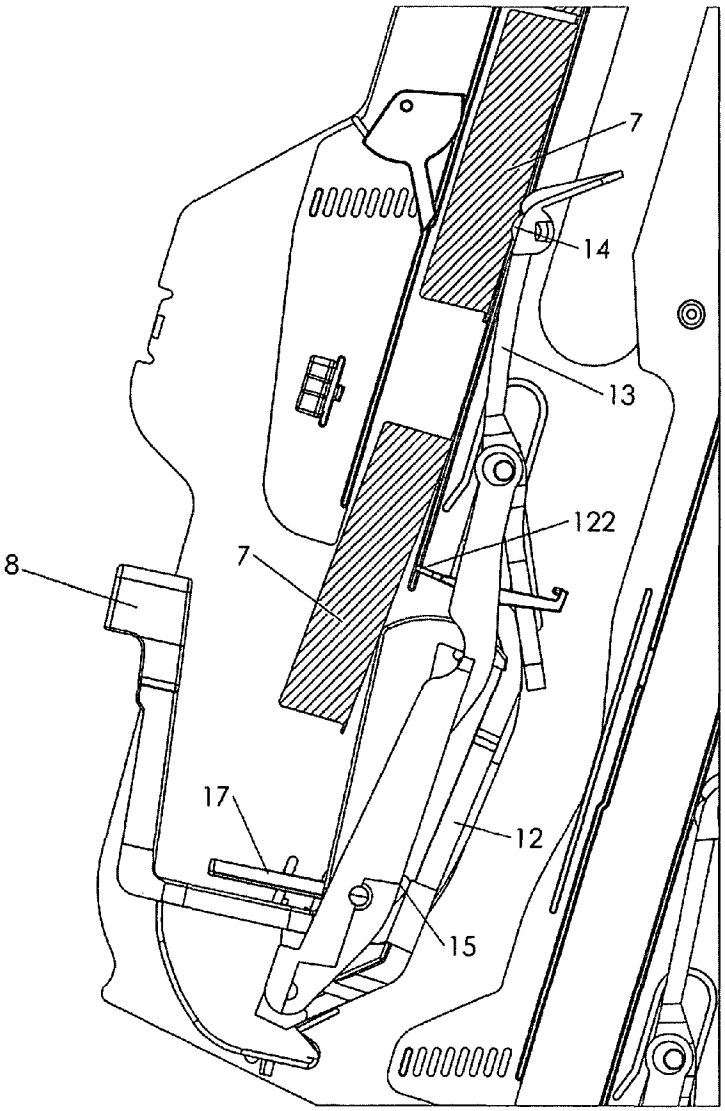
FIG. 6C shows a side view of a cartridge assembly according to an embodiment of the invention, wherein the pocket is returning to its closed position, and another product is dropping into the pocket.

FIGS. 6A and 6B show escapement member 12 in its forward position, wherein escapement shelf 122 is in position to prevent a product 7 in chute 50 from dropping into pocket 8. FIG. 6C shows escapement member 12 in its retracted position, wherein escapement shelf 122 is in position to allow product 7 to drop into pocket 8.

Escapement member 12 may be coupled to a chassis 11 which is coupled to pocket 8. Chassis 11 may be rotatably or hingedly coupled to pocket 8 and/or escapement member 12, such that pocket 8 can move between its open and closed positions and escapement member 12 can move between its forward and retracted positions in a pivoting manner with respect to chassis 11.

A cam body 15 having one or more cam surfaces 151 is coupled to lever switch 17. Cam body 15 is movable between a first position non contact-disabled wherein cam surface 151 is received in recess 121 of escapement member 12 and a second position wherein cam surface 151 is not received in recess 121 position in contact-enabled of escapement member 12. Lever switch 17 may engage cam body 15 such that the cam body slides between its first and second position, wherein when lever switch 17 is in its depressed position, cam body 15 is in its first position and cam surface 151 is received in recess 121, and when lever switch 17 is in its raised position, cam body 15 is in its second position and cam surface 151 is not received in recess 121.

FIG. 5A shows cam body 15 in its first disabled position wherein cam surface 151 would engage recess 121 and FIG. 5B shows cam body 15 in its second enabled position wherein cam surface 151 would not engage recess 121.

A timer device 10 is disposed between pocket 8 and escapement member 12. Timer device 10 retards a rate of movement of escapement member 12 between its forward and retracted positions, thereby delaying or increasing the time required for a second product to drop into pocket 8 once a first product has been dispensed or removed.

Timer device 10 may include a flexible bladder, such as a plastic bag or bellows that is sealed on all sides and has a large aperture through which air can enter with a small aperture through which air can escape and a passive valve to seal off the large aperture when the pocket closes. The flexible bladder may contain air or fluid which escapes upon the application of pressure and is inflated when air or fluid enters the flexible bladder when pressure is removed. The large aperture 101 may be positioned to be covered by a sealing membrane secured to the rear portion of the pocket 8 as the pocket moves into its closed position.

Timer device 10 may further include a spring 102, such as a coil spring, spider spring or other type of spring, disposed within the flexible bladder for increasing the rate at which the flexible bladder inflates as pocket 8 is moved from its closed to its open position.

As shown in FIG. 3B, timer device 10 may also be in the form of a bellows 103 which is coupled to the pocket 8 and to a stationary plane. The bellows may be attached to a surface of the pocket 8 and an opposing surface without any spring, The timer device 10 may include two apertures, for example a large aperture 104 through which air can enter ("inhale") as the pocket 8 opens, and a smaller aperture 111 through which air may escape ("exhale") as the pocket 8 closes. A valve 105, such as a passive valve, may be provided, wherein the valve closes the large aperture 104 when the pocket closes.

FIGS. 3A and 3B show a brake arm or upper index arm 13 which may be coupled to escapement member 12. Brake arm 13 is movable between an engaged position wherein brake arm 13 presses against a product 7 in chute 50 and prevents the product 7 from dropping in the chute 50, and a released position wherein the product 7 can drop in chute 50 onto escapement shelf 122 of escapement member 12. The brake arm or upper index arm 13 moves from its engages position to its released position as escapement member 12 is moved from its retracted position to its forward position. As shown, brake arm or upper index arm 13 is disposed on a same side of cartridge assembly 1 as escapement member 12. In an alternate embodiment, brake arm 13 may be positioned opposite escapement member 12, that is on the other side of cartridge assembly 1.

FIGS. 6A and 6B show brake arm 13 in its released position, wherein product 7 (uppermost product shown) is permitted to drop in chute 50 onto escapement shelf 122. FIG. 6C shows brake arm 13 in its engaged position, wherein brake arm 13 presses against product 7, preventing product 7 from dropping in chute 50.

Brake arm 13 may include one or more brake pads 14 for contacting product 7 when brake arm 13 is in its retracted position. Brake Pads 14 may improve the friction properties of brake arm 13 to better secure product 7 in chute 50. Brake pads 14 may comprise a rubber material, or any other material suitable for securing product 7 in chute 50 such that product 7 does not drop in chute 50.

FIGS. 6A, 6B and 6C illustrate the operation of a display device according to an embodiment of the invention.

In particular, FIG. 6A shows the cartridge assembly 1 filled with a product 7 (lowermost product) in pocket 8 ready for dispensing. Lever switch 17 is in its depressed position and escapement shelf 122 of escapement member 12 is in its forward position, preventing product 7 (middle position) from dropping into pocket 8.

As product 7 is removed from pocket 8 when pocket 8 is in its open position, as for example by a consumer who desires to purchase product 7, lever switch 17, biased by second biasing member 16, moves into its raised position and cam body 15 moves into its second position (See FIG. 6B). Moreover, opening pocket 8 actuates timer device 10, for example by removing pressure from timer device, causing it to inflate. Opening pocket 8 may and cause air to rush into the flexible bladder or bellows through its openings, thereby inflating flexible bladder or bellows.

As pocket 8 is subsequently moved from its open position to its closed position, biased by first biasing member 9, for example when a consumer releases pocket or pull cradle 8 after removing product 7, cam surface 151 engages escapement member 12. This moves escapement member 12 into its retracted position, allowing another of the products 7 to drop from chute 50 into empty pocket 8 to replace the product which was removed or dispensed. The movement of escapement member 12 into its retracted position is slowed by the timer device 10, for example, by deflating the flexible bladder or bellows as pocket 8 or platen 20 pressing against flexible bladder or bellows, sealing aperture 101. Thus timer device 10 restricts escapement member 12 from immediately fully retracting due to the action of the air pressure inside timer device 10. As the air inside timer devise 10 is forced out aperture 101, by the pressure of pocket 8 and/or platen 20, escapement member 12 more fully retracts.

In particular, in the embodiment illustrated in FIG. 6C, as pocket 8 closes, with cam body 15 in its second position, cam surface 151 pushes escapement member 12 to its retracted position. Before escapement member 12 is sufficiently open to drop product 7 into pocket 8, brake arm 13 presses against the second product 7 in chute 50, possibly flexing significantly in doing so. Brake pads 14 on brake arm 13 improve the friction properties to secure second product 7. Timer device 10, having been inflated possibly with or without the aid of spring 102, has the aperture 101 sealed as platen 20 on pocket 8 closes. The timer device 10 thus deflates slowly, increasing the time required for pocket 8 to be reloaded.

Once escapement member 12 reaches its fully retracted position, bottom product 7 falls into pocket 8, depressing lever switch 17. This restores the cartridge assembly to the state illustrated in FIG. 6A, wherein cam body 15 is moved back to its first position, and escapement member 12 is returned to its forward position. Brake arm 13 coupled to escapement member 12 is simultaneously released, allowing the remainder of products 7 to drop in chute 50. Cartridge assembly 1 is thus restored to the state shown in FIG. 6A and is ready to dispense the next product.

Chute 50 may be adjustable to accommodate various sizes of product packaging. FIGS. 7A and 7B show a display device according to an embodiment of the invention wherein adjustable guides 6 are positioned to accommodate a relatively large product. Cartridge assembly 1 is arranged between first and second dividers or divider walls 2. First and second adjustable guides 6 are coupled to respective first and second dividers 2 and define a portion of chute 50. For example, a pair of adjustable guides 6 may define a front portion of chute 50 and a pair of fixed guides 4 may define a rear portion of chute 50. First and second guides 6 are movable for adjusting the dimensions of chute 50 to accommodate products having various sizes.

For example, dividers 2 may each include associated projections or locator posts 210 and adjustable guides 6 may include associated spaced apart openings or slots 61 for receiving a corresponding projection 210. By positioning a selected opening 61 in guide 6 on a corresponding projection 210 on divider 2, the size of chute 50 may be adjusted to accommodate a particular product size to be displayed and dispensed. Cartridge assembly 1 requires no adjustment. Additionally, adjustable guides 6 may be configured to be slidably movable to accommodate products of various sizes.

Adjustable guides 6 may be secured using guide locks 21. As shown in FIG. 7A, guide locks 21 may comprise pivoting members which are coupled to guides 6. Chute 50 may be adjusted by lifting guide locks 21 (FIG. 7A shows guide locks 21 in a lifted or raised position), removing guides 6 and replacing guides 6 by positioning a selected opening or slot 61 over projection 210 such that guide 6 forms the desired chute size. Guide locks 21 are then pressed down to lock guides 6 into the new position. The pair of guides 6 forming a particular chute must be at the same position, that is the same associated opening 61 must be used on the guides 6 in order to use the guide locks 21 and dispense the products properly.

Figure 8B:
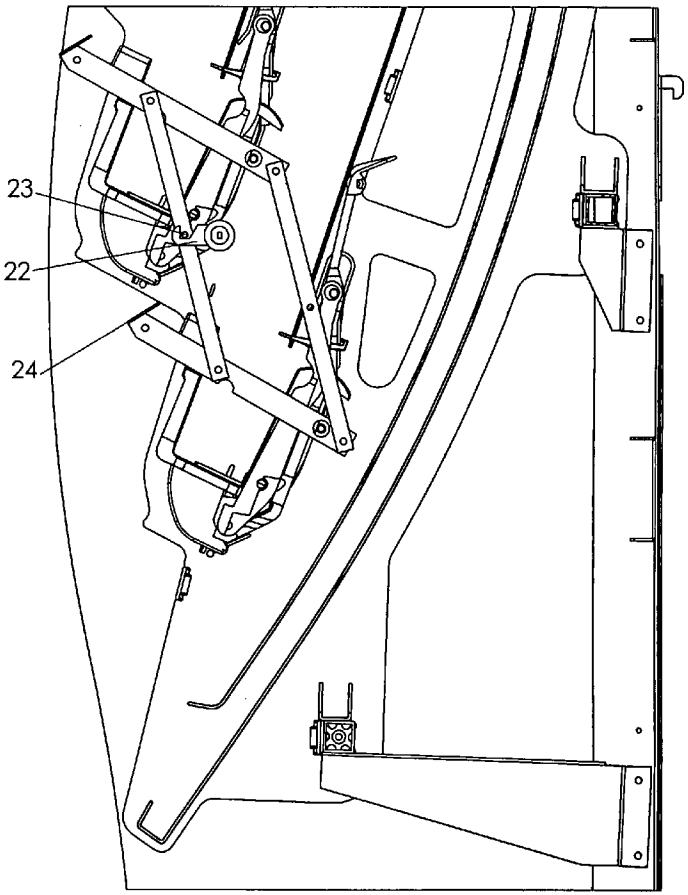
FIG. 8B shows a side view of a display device according to an embodiment of the invention with a locking mechanism in a locked state.
Figure 8A:
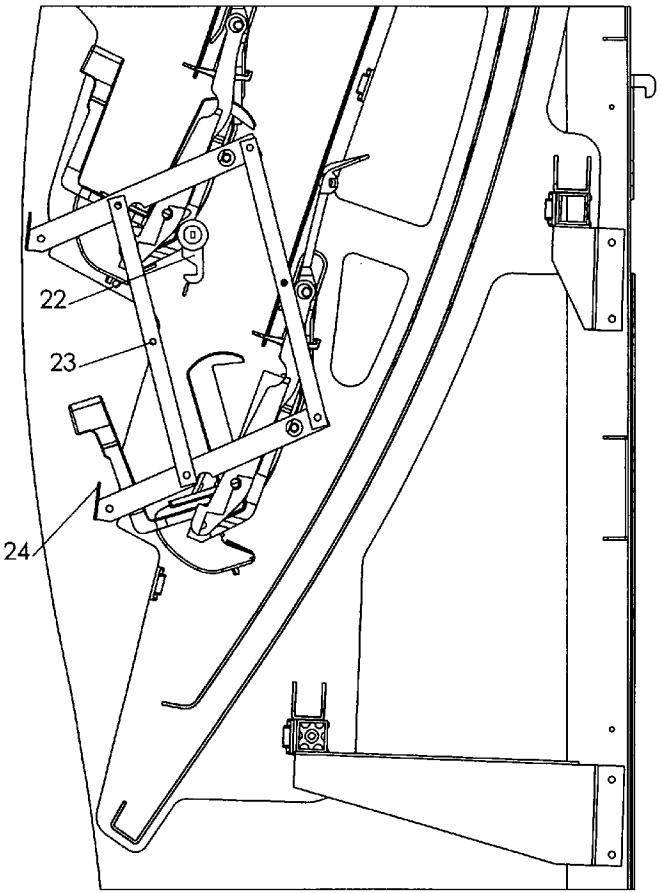
FIG. 8A shows a side view of a display device according to an embodiment of the invention with a locking mechanism in an unlocked state.

FIG. 8A shows a display device according to an embodiment of the invention with a locking mechanism in an unlocked state and FIG. 8B shows the locking mechanism in a locked state. The locking mechanism is movable between an unlocked state, shown in FIG. 8A, wherein pocket 8 can be moved from its closed position into its open position and a locked state, shown in FIG. 8B, wherein pocket 8 cannot be moved from its closed position into its open position.

The locking mechanism May include a plurality of pivoting members and a cross bar 24 extending across cartridge assembly or assemblies 1. A hook 22, such as a hooked cam, may be rotatable coupled to the cartridge assembly and a pin 23 may extend out from one of the pivoting members. Hook 22 engages pin 23 to lock the locking mechanism. As shown in the embodiment of FIG. 8A, when the locking mechanism is in its unlocked state, cross bars 24 may be in a lowered position and hook 22 is not engaging pin 23, thereby allowing pockets 8 to be opened. As shown in the embodiment of FIG. 8B, in the locked state, cross bars 24 are in the upper position and hook 22 catches pin 23 to prevent unauthorized access.

In particular, the locking mechanism may function to lock out all of the pockets in a display device according to an embodiment of the invention. For example, the locking mechanism illustrated in FIGS. 8A and 8B would lock all of the cartridge assemblies in a display device assembly as shown in FIG. 1, both upper and lower rows.

Figure 11:
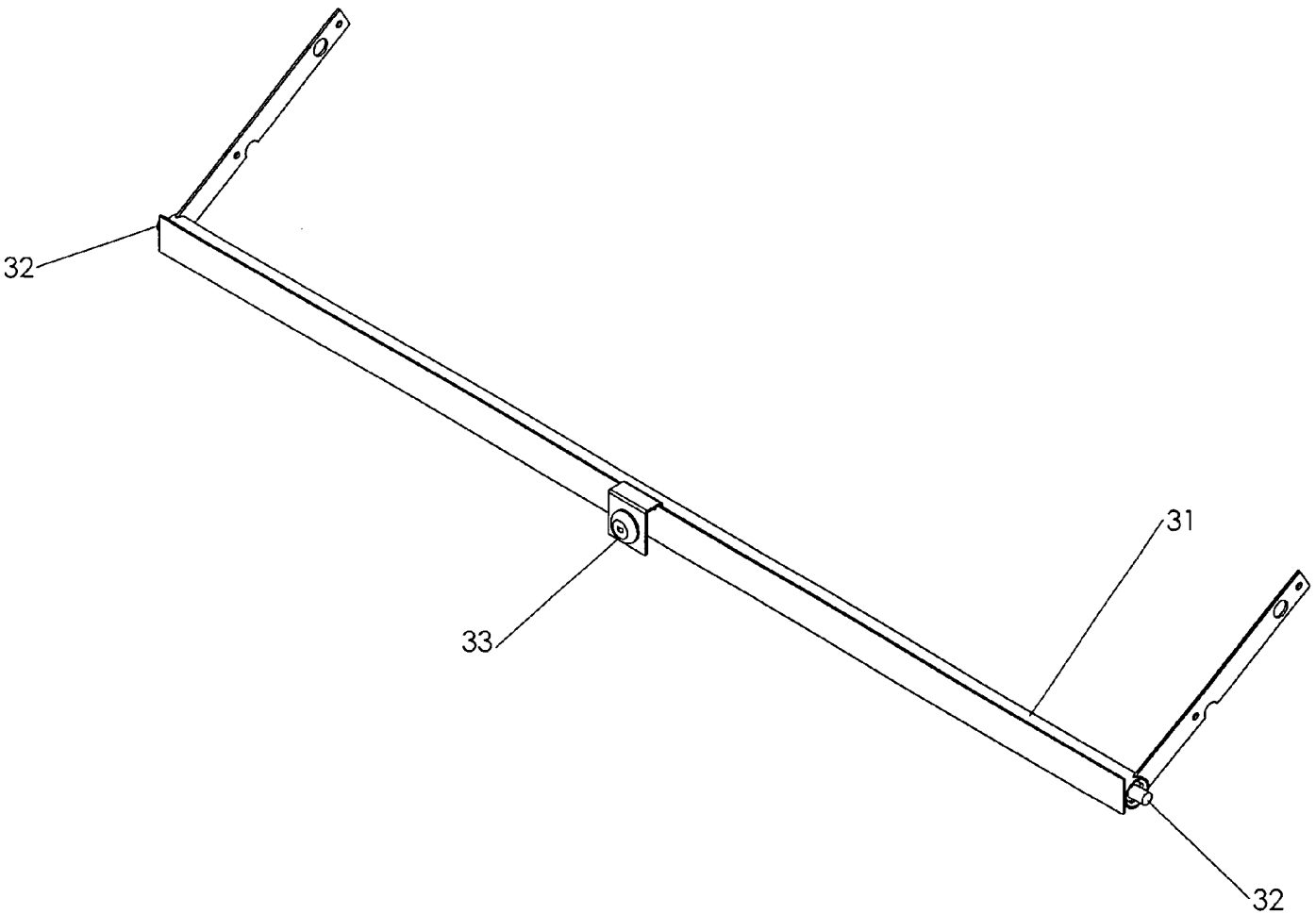
FIG. 11 shows a locking mechanism for a display device according to an embodiment of the invention.

FIG. 11 shows a locking mechanism for a display device according to another embodiment. In this embodiment, the display device may include a locking mechanism which is movable between an unlocked state, wherein the pocket can be moved from its closed position to its open position, and a locked state, wherein the pocket cannot be moved from its closed position to its open position. The locking mechanism may include a horizontal enclosure 31 with retractable pins 32 at each end. The inner portions of the pins are connected to the rotating part of a centrally positioned keyed cam lock 33. Turning a key retracts the pins 32 allowing the mechanism to move freely between the closed and open positions. With the key rotated to its removable station the pins 32 are extended and engaged into corresponding holes to secure the mechanism into either the unlocked state or the locked state.

Figure 9A:
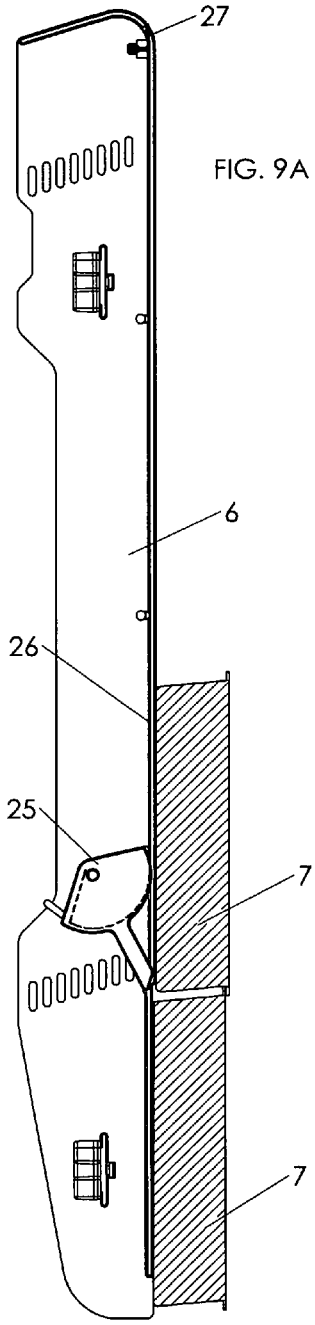
FIG. 9A shows a side view of a portion of a display device according to an embodiment of the invention with an indicator indicating a sufficient number of products in an associated display device chute.
Figure 9B:
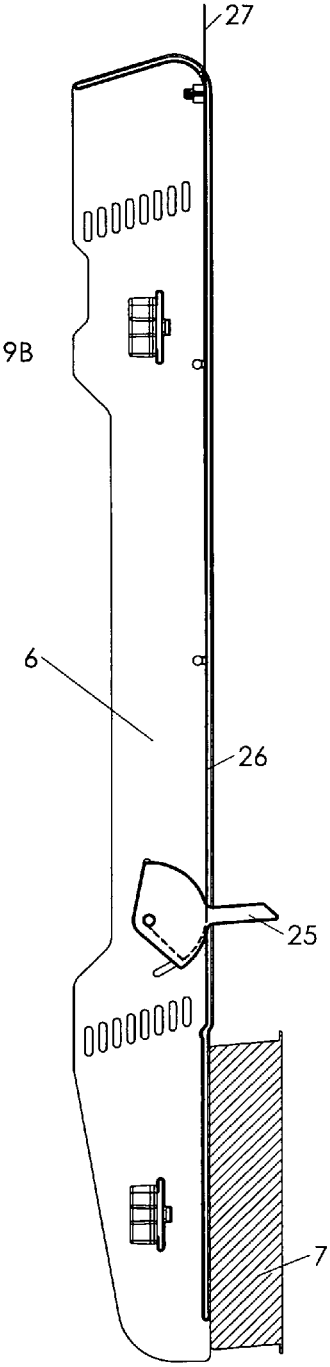
FIG. 9B shows a side view of a portion of a display device according to an embodiment of the invention with an indicator indicating an insufficient number of products in an associated display device chute.

FIG. 9A shows a portion of a display device according to an embodiment of the invention with an indicator indicating a sufficient number of products in an associated display device chute. FIG. 9B shows a portion of the display device wherein the indicator is indicating an insufficient number of products in the associated the display device chute. The indicator may include an upwardly biased lever or flag lever 25 which is pivotally coupled to a guide 6 or divider 2. A spring member 26, such as a length of flat spring material, may be coupled to lever 25 and a flag 27. A portion of the lever 25 may extend into the chute.

When there are a sufficient number of products in the chute, the lever 25 is depressed and a flag 27 is retracted to a position wherein the flag is hidden or not visible. When there are an insufficient number of products in the chute, lever 25 is released and flag 27 is raised by the straightening of spring member 26. The raised flag 27 thereby provides a visible indicator of the number of products in an associated chute. In an arrangement including multiple cartridge assemblies and chutes, taller flags 27 may be provided as needed, so as to be readily visible in the display device assembly.

Figure 10A:
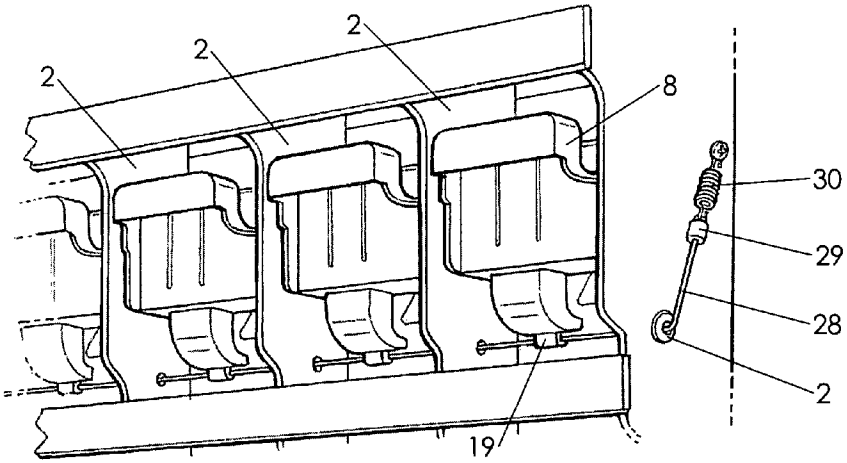
FIG. 10A shows a display device according to an embodiment of the invention with a mechanism for allowing only one pocket in a row of cartridge assemblies to be opened at once.
Figure 10B:
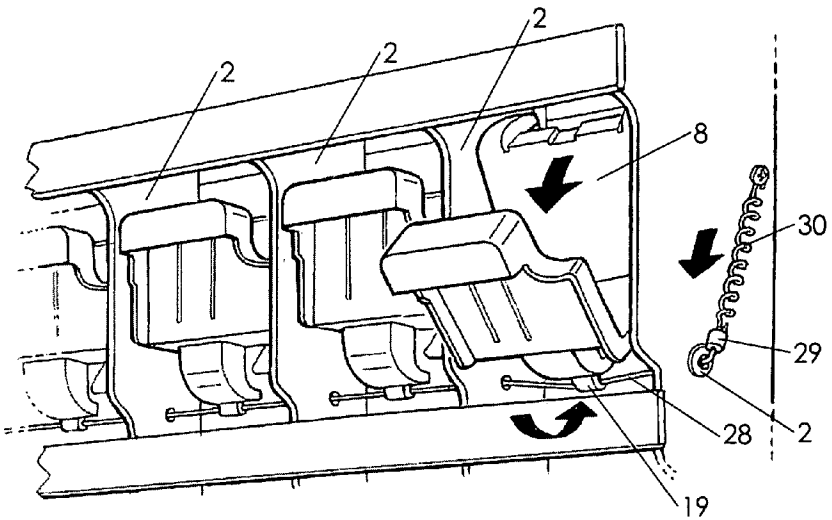
FIG. 10B shows the mechanism of FIG. 10A in operation.

FIG. 10 A shows a display device according to an embodiment of the invention with a mechanism for allowing only one pocket in a row of cartridge assemblies to be opened at once and FIG. 10B shows the mechanism of FIG. 10A in operation. As shown, a plurality of cartridge assemblies are arranged in a line, separated by respective dividers 2. Each of the dividers 2 has an opening or hole there through. A projection or finger 19 is provided on each of the cartridge assemblies, for example on a bottom portion of the cartridge assembly. The projection or finger 19, may be for example a loop or hook, such as a slit tube or tight hook to prevent disabling of the mechanism.

A cable 28, for example a light steel cable, a strong string or the like is threaded through the holes in the dividers 2. One end of the cable 28 may be secured fast and the other end of the cable 28 may be connected to a spring 30 to provide tension. A stop 29 may be clamped to the cable 28 to limit its travel and prevent damage to spring 30.

When the pockets in a line of cartridge assemblies are all in the closed or upright position, the cable 28 may be relatively loose, such that any of the pockets may be opened. As one of the pockets 8 of the cartridge assemblies in a line is opened, the projection or finger 19, which may be a loop or hook, associated with that cartridge assembly imparts a tension on cable 28 and prevents each of the other pockets from the remaining cartridge assemblies from being moved to their open positions.

For example, when one pocket 8 is opened, the loop or hook feature 19 on the bottom of that pocket may catch cable 28 and stretch spring 30, bringing stop 29 almost all the way to the hole in the end divider 2. With cable 28 thus in tension, attempting to open another pocket or pockets would cause the associated loop or hook feature to catch the cable and fail to open. Thus only one pocket 8 in a line may be opened at a time. Such a mechanism, coupled with the afore-described timer device 10, substantially increases the time period required to retrieve multiple products from a row of the display device, thus impeding would-be thieves from obtaining multiple pieces of the same product.

Accordingly, while several embodiments of the present invention have been shown and described, it is obvious that many changes and modifications may be made thereunto without departing from the spirit and scope of the invention.

What is claimed is:

1. A display device comprising:

a) a chute for supporting a plurality of products in a stacked arrangement; and b) a cartridge assembly disposed at a lower end of said chute for dispensing a lowermost product of the plurality of products, said cartridge assembly comprising:

i) a pocket for receiving the product to be dispensed, said pocket being movable between an open position wherein the product may be removed from said pocket and a closed position;

ii) a first biasing member coupled to said pocket for biasing said pocket into said closed position;

iii) a lever switch having a portion disposed within said pocket, said lever switch being movable between a depressed position when the product is disposed within said pocket and a raised position when the product is removed from said pocket;

iv) a second biasing member coupled to said lever switch for biasing said lever switch into said raised position;

v) an escapement member comprising an escapement arm having a recess and an escapement shelf disposed over said pocket in a forward position, said escapement member being movable between said forward position wherein said escapement shelf prevents a product of said plurality of products in said chute from dropping into said pocket and a retracted position wherein the product can drop from said chute into said pocket;

vi) a cam body coupled to said lever switch, said cam body comprising a cam surface, said cam body being movable between a first position wherein said cam surface is received in said recess of said escapement arm and a second position wherein said cam surface is not received in said recess; and vii) a timer device disposed between said pocket and said escapement member for retarding a rate of movement of said escapement member between said forward position and said retracted position;

wherein as the product is removed from said pocket when said pocket is in said open position, said lever switch moves to said raised position and said cam body moves to said second position;

wherein as said pocket is subsequently moved from said open position to said closed position, said cam surface engages said escapement member, moving said escapement member into said retracted position, allowing another of said plurality of products to drop from said chute into said pocket; and wherein as said another of said plurality of products drops from said chute into said pocket, said lever switch is moved to said depressed position, moving said cam body into said first position and returning said escapement member to said forward position.

2. The display device according to claim 1, wherein said cartridge assembly is detachable from said chute.

3. The display device according to claim 1, further comprising a brake arm coupled to said escapement member, said brake arm being movable between an engaged position wherein said brake arm presses against a product of said plurality of products in said chute and prevents the product from dropping in said chute and a released position wherein the product can drop in said chute onto said escapement shelf, wherein as said escapement member is moved from said retracted position to said forward position, said brake arm moves from said engaged position to said released position.

4. The display device according to claim 3, wherein said brake arm further comprises a brake pad for contacting the product when said brake arm is in said engaged position.

5. The display device according to claim 1, wherein said first biasing member comprises a spring.

6. The display device according to claim 5, wherein said spring comprises a coil spring.

7. The display device according to claim 1, wherein said second biasing member comprises a spring.

8. The display device according to claim 7, wherein said spring comprises a flat spring.

9. The display device according to claim 1, wherein said timer device comprises a flexible bladder.

10. The display device according to claim 9, further comprising a first aperture through which air can enter said flexible bladder and a second aperture through which air can escape said flexible bladder.

11. The display device according to claim 1, wherein said timer device comprises a bellows.

12. The display device according to claim 11, further comprising a first aperture through which air can enter said bellows and a second aperture through which air can escape said bellows.

13. The display device according to claim 12, wherein said first aperture is a large aperture through which air can enter, said second aperture is a small aperture through which air can escape and the display device further comprises a passive valve for sealing off said first aperture as said pocket moves into said closed position.

14. The display device according to claim 9, further comprising a spring disposed within said flexible bladder, wherein said spring increase a rate of inflation of said flexible bladder as said pocket is moved from said closed to said open position.

15. The display device according to claim 1, further comprising:

a) a first divider and a second divider, said cartridge assembly being arranged between said first divider and said second divider; and b) a first adjustable guide coupled to said first divider and a second adjustable guide coupled to said second divider, said first and second adjustable guide defining a portion of said chute;

wherein said first adjustable guide and said second adjustable guide are movable for adjusting said chute to accommodate products of various sizes.

16. The display device according to claim 15, wherein said first divider comprises a first projection; said second divider comprises a second projection; said first adjustable guide comprises a first plurality of spaced apart openings for receiving said first projection; and said second adjustable guide comprises a second plurality of spaced apart openings for receiving said second projection.

17. The display device according to claim 1, further comprising a locking mechanism, said locking mechanism being movable between an unlocked state, wherein said pocket can be moved from said closed position to said open position, and a locked state, wherein said pocket cannot be moved from said closed position to said open position.

18. The display device according to claim 17, wherein said locking mechanism comprises a hook rotatably coupled to said cartridge assembly and a pin, wherein said hook engages said pin when said locking mechanism is in said locked state.

19. The display device according to claim 17, wherein said locking mechanism comprises a horizontal enclosure with retractable pins disposed at each end, wherein an inner portion of said retractable pins is connected to a rotating portion of a centrally positioned keyed cam lock, wherein said keyed cam lock is movable between a first position where said pins are retracted allowing said pocket to move freely between the closed and open positions and a second position wherein said pins are extended and engage corresponding holes to secure the mechanism into either the unlocked state or the locked state.

20. The display device according to claim 1, further comprising an indicator for indicating an amount of the plurality of products in said chute, said indicator comprising an upwardly biased lever disposed in said chute and a flag coupled to said upwardly biased lever.

21. The display device according to claim 1, wherein said cartridge assembly comprises a plurality of cartridge assemblies arranged in a line, said plurality of cartridge assemblies separated by respective dividers, each of said respective dividers having an opening therethrough, and each of said plurality of cartridge assemblies comprising a respective projection; said display device further comprising a cable, said cable extending through said opening in each of said dividers;

wherein as a pocket of one of said plurality of cartridge assemblies is moved to said open position, said projection associated with said one of said plurality of cartridge assemblies imparts a tension on said cable and prevents a pocket from each other of said plurality of cartridge assemblies from being moved to said open position.

* * * * *